US005474485A

United States Patent [19]

Smrt

[11] Patent Number: 5,474,485

[45] Date of Patent: Dec. 12, 1995

[54] ANIMATION METHOD AND DEVICE

[76] Inventor: Thomas J. Smrt, 10014 S. Grant Hwy., Marengo, Ill. 60152

[21] Appl. No.: 262,912

[22] Filed: Jun. 21, 1994

Related U.S. Application Data

[62] Division of Ser. No. 957,228, Oct. 6, 1992, Pat. No. 5,322,468, which is a continuation of Ser. No. 727,889, Jul. 10, 1991, Pat. No. 5,205,774, which is a division of Ser. No. 575,984, Aug. 31, 1990, abandoned, which is a continuation-in-part of Ser. No. 482,146, Feb. 20, 1990, Pat. No. 5,104,346.

[51] Int. Cl.[6] ..... A63H 13/00; G09F 19/08

[52] U.S. Cl. ..... 446/199; 92/48

[58] Field of Search ..... 446/199, 180, 446/220, 198, 197, 190, 226, 221; 40/412, 422, 477, 439; 92/89–92, 48

[56] References Cited

U.S. PATENT DOCUMENTS

| | | | |
|---|---|---|---|
| 536,512 | 3/1895 | Crossley et al. | 446/198 |
| 712,601 | 11/1902 | Savage | 446/198 X |
| 2,047,377 | 7/1936 | Liwschutz | 446/190 X |
| 2,230,138 | 1/1941 | Ewart . | |
| 2,489,799 | 11/1949 | Minshall | 92/91 X |
| 2,698,499 | 1/1955 | Dygon | 446/198 |
| 3,229,590 | 1/1966 | Huska | 92/92 X |
| 3,594,942 | 7/1971 | Hollingsworth et al. | 446/198 |
| 4,683,669 | 8/1987 | Greer, Jr. | 446/337 X |
| 4,751,868 | 6/1988 | Paynter | 92/92 X |
| 4,759,737 | 7/1988 | Ferenczi | 446/183 |
| 5,090,297 | 2/1992 | Paynter | 92/92 X |
| 5,104,346 | 4/1992 | Smrt | 446/199 |

FOREIGN PATENT DOCUMENTS

| | | | |
|---|---|---|---|
| 475405 | 4/1929 | Germany | 446/185 |

*Primary Examiner*—Mickey Yu
*Attorney, Agent, or Firm*—Leydig, Voit & Mayer, Ltd.

[57] ABSTRACT

There now has been discovered a simple, straight-forward apparatus and method for animating figures. The apparatus and method in one embodiment employs a plurality of collapsible, fluid chambers, and associated structures for controlling the fluid pressure in each of the chambers. At least two of the chambers are physically arranged so that the inflation of one such chamber and deflation of the other complimentary chamber causes all or a part of the figure to assume a different spatial position, dependent upon the level of inflation of each of the chambers. In another embodiment, a single, inflatable chamber is employed, the chamber having a section of one wall which is less elastic than the remaining portion of the wall. Due to the differential in elasticity, upon inflation the chamber assumes a shape or configuration which is different from the noninflated chamber. In a third embodiment, two collapsible, fluid chambers, and associated structures for controlling the fluid pressure in each of the chambers are provided. The chambers are each helically wound in opposite directions and placed substantially parallel to one another. Upon application of fluid pressure to either chamber, rotation of that chamber occurs, causing the helical windings of that chamber to unwind while commensurately causing the other chamber to be more tightly, helically wound. The partial or complete inflation of either chamber causes all or a part of the figure to assume a different spatial position, dependent upon the level of inflation of each of the chambers.

4 Claims, 9 Drawing Sheets

ANIMATION METHOD AND DEVICE

CROSS-REFERENCE TO RELATED APPLICATIONS

This is a divisional of application Ser. No. 07/957,228, filed on Oct. 6, 1992, now U.S. Pat. No. 5,322,468, which is a continuation of Ser. No. 07/727,889, filed Jul. 10, 1991, now U.S. Pat. No. 5,205,774, which is a divisional of Ser. No. 07/575,984, filed Aug. 31, 1990, abandoned, and which is a continuation-in-part of Ser. No. 07/482,146, filed Feb. 20, 1990, now U.S. Pat. No. 5,104,346.

FIELD OF THE INVENTION

This invention relates generally to animated figures and more specifically to an apparatus and method for achieving animation or motion in such figures.

BACKGROUND OF THE INVENTION

Small animated figures such as dolls or figures which are part of music boxes, clocks and the like have existed for hundreds of years. Such animation has classically been achieved through the use of mechanical gearing. In modern times, animation has been achieved through the use of electro-mechanical designs requiring extremely complex electrical circuitry and associated mechanical devices, such as expensive servo-motors and the like. More recently, with the development of amusement and theme parks, the need to animate much larger figures, such as full size human and animal replicates, has arisen.

As the size of the figure to be animated increases, the complexity of the electro-mechanical design requirements grows commensurately. In part, the one approach has been to employ pneumatics to achieve animation of such large figures. However, the resulting animation has been crude, at best, and incapable of duplicating fine motion, such as that demonstrated by a human finger. When dealing with very large figures, the devices needed to effectively animate fine, detailed motion are extremely expensive and require special electrical current, along with complicated control circuitry. Even that solution, however, cannot achieve rapid, realistic motion, as the time necessary for the figure to change from one position to another is limited by the time necessary for servo-motors to reposition themselves.

Further, to realistically animate some figures, the need also arises for the animated character to exhibit a significant degree of strength. An unfortunate drawback of the electro-mechanical means of animating figures, typically, is a lack of ability to exhibit such significant strength.

Because of the complexity of the task, only the largest of companies have been able to afford to design and build large animated figures, which still suffer from the aforementioned shortcomings. Of course, the public visiting theme parks and the like displaying such animated figures have been required to pay higher prices of admission to allow the theme park operator to recoup the high investment costs required to construct the figures used in the park in the first instance.

A need thus exists for a relatively simple means to achieve realistic animation or motion in figures, especially large figures, such as replications of horses, dragons and the like, without the use of expensive, electro-mechanical motors. A need also exists for a means of animating figures in a manner which allows the characters to perform tasks requiring a level of strength and rapidity of motion not capable of being exhibited by figures animated through electro-mechanical servo motors and the like.

SUMMARY OF THE INVENTION

There now has been discovered a simple, straight-forward means for animating figures through the use of the apparatus and method of the present invention. In a first embodiment, the apparatus and method of the present invention employ a plurality of collapsible, fluid chambers, and associated means for controlling the fluid pressure in each of said chambers. At least two of said chambers have inflated spatial orientations which cause all or a part of the figure to assume a different position, dependent upon the level of inflation of each of said chambers. In a typical configuration, the chambers are arranged so that the inflation of one such chamber exerts a physical force on the other.

In one aspect of the first embodiment, there is present a device for providing rotational movement comprising an assembly having (1) a first body section, (2) a second body section which is rotatably associated with the first body section, (3) a first collapsible chamber having a first and a second end, wherein one of said ends is rigidly associated with the first body section and the other of said ends is rigidly associated with the second body section and (4) a second collapsible chamber having a first and a second end, wherein one of said ends is rigidly associated with the first body section and the other of said ends is rigidly associated with the second body section, wherein the first and second collapsible chambers have the configuration of a segment of a circle, said chambers being mounted such that when either of said chambers is collapsed, the other chamber is inflated. Such a device is particularly suited for providing animation for portions of figures, such as for duplication of the rotational movement of a torso.

In another aspect of this embodiment, the two collapsible chambers are both located within a third chamber which is not directly inflated, but responds in configuration to the inflation, in whole or in part, of the two interior chambers.

In yet another aspect of this embodiment, two chambers are employed wherein one chamber is located within the other and only one chamber is inflatable. The noninflatable chamber has a spatial orientation which is different from the spatial orientation of the inflatable chamber when inflated. When the inflatable chamber is not inflated, the figure assumes the shape of the noninflatable chamber. When the inflatable chamber is inflated, however, the inflation of the chamber causes all or a part of the figure to assume a different position, dependent upon the level of inflation of that chamber. Typically, the exterior chamber will be the noninflatable chamber and the interior chamber will be the inflatable chamber, although the reverse configuration could be employed, although with more difficulty.

In a second embodiment of the present invention, a single, inflatable chamber is employed, said chamber having a section of one wall which is less elastic than the remaining portion of the wall. Due to the differential in elasticity, upon inflation the chamber assumes a shape or configuration which is different from the noninflated chamber.

In a third embodiment, two collapsible, fluid chambers, and associated means for controlling the fluid pressure in each of said chambers are provided. The chambers are each helically wound in opposite directions and placed substantially parallel to one another. At one spatial point one end of each chamber is rigidly mounted so that rotation of each respective chamber at that point is not possible. The opposite ends of each respective chamber are rigidly associated with each other so that rotation of one chamber causes rotation of the other in the same direction of rotation. Upon application of fluid pressure to either chamber, rotation of that chamber occurs, causing the helical windings of that chamber to unwind while commensurately causing the other chamber to be more tightly, helically wound. Upon release of the fluid pressure, the previously inflated chamber is again caused to be helically rewound to its initial state, due to the rotational force generated by the partial unwinding of the other chamber, until each chamber is wound back to its initial, helically wound state. The partial or complete inflation of either chamber causes all or a part of the figure to assume a different spatial position, dependent upon the level of inflation of each of said chambers.

BRIEF DESCRIPTION OF THE DRAWINGS

FIGS. 1A, 1B and 1C show a cut-away view of the arm alone, while FIGS. 1D and 1E show the arm is attached to a torso, along with the associated control equipment.

FIGS. 2D, 2E and 2F are sectional views of FIGS. 2A, 2B and 2C, respectively.

DETAILED DESCRIPTION OF THE PREFERRED EMBODIMENTS

Figures 1, 1A:
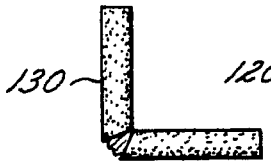
FIGS. 1A, 1B, 1C, 1D and 1E illustrate one aspect of the first embodiment of the present invention for providing animation for the arm of a human figure.

In accordance with the present invention, animation of figures, whether large or small, can be achieved through the use of a simplified device and method. The device can take the form of enumerable specific embodiments, all of which are within the scope of the present invention. In accordance with the first embodiment, at least two collapsible chambers which are independently connected to a fluid supply means are employed. At least two such chambers are placed in such physical relationship that the inflation of either chamber and deflation of its complimentary chamber, causes an outward movement of the figure. Typically, inflation of one chamber places a force on another, complimentary chamber. Such force tends to cause the collapse of that other chamber.

The collapsible chambers used in the various aspects and embodiments of the present invention may be constructed of any suitable elastic material, such as natural or synthetic rubber, including styrene-butadiene rubber. The composition of the chamber is not critical as long as it is flexible and collapsible over repeated cycles of inflation and deflation.

The collapsible chambers should be as fluid-tight as possible, to minimize the energy necessary to change and maintain the chambers in a state of inflation or deflation. The fluid necessary to cause the inflation or deflation of the chambers likewise is not critical, although for ease and simplicity of design, fabrication, and operation, it is preferred to use air to inflate the chambers. The pressure maintained in the chambers when inflated likewise is not critical and any pressure over atmospheric is desirable, such as from about 2 to about 200 psi. Essentially, there is no limitation upon the amount of pressure which may be employed, as the components of the system may be varied in design to accommodate the desired pressure. The amount of pressure employed to inflate a chamber is directly translatable into the amount of strength which may be exhibited by the animated character. Further, the pressure differential maintained between inflated chambers and deflated chambers is directly translatable into speed. The greater the differential, the more quickly that a given chamber can inflate and a second chamber, if present, deflate, allowing the figure to rapidly change in outward appearance.

Preferably, the chambers, when inflated, will be inflated to a pressure from about 20 psi to about 80 psi, more preferably to a pressure of about 50 psi. Likewise, when employed, a deflated chamber will be maintained at atmospheric pressure or below. Typically, the pressure necessary to operate the system will be supplied from a conventional air compressor, capable of being operated by conventional 110 volt current or even batteries.

In accordance with the first embodiment of the present invention, when one chamber is inflated, typically that inflated chamber will apply a force to the other, although that force need may not be fully opposing in the sense that full inflation of the one chamber would necessarily cause full collapse of the other. Hence, the force exerted by one chamber against the other also may be tangential, as illustrated in the embodiments discussed below.

To provide for the ability to inflate the chambers, each chamber is placed in fluid communication with a fluid supply means which is capable of supplying fluid thereto through a fluid supply conduit. Respective fluid control means, or valves, control the fluid flow to each of the collapsible chambers. Normally the valves are of the type which are either fully open or fully closed, although in some applications valves capable of being placed in partially open positions may be employed in typical operation, when the valve to one of the collapsible chambers is placed in a closed position, the valve associated with the opposing chamber is placed in an open position.

In accordance with one aspect of the first embodiment of the present invention, both inflatable chambers may be located within a third, encasing chamber which itself is not directly inflated. In such a construction, both of the chambers are maintained in close physical proximity along their length and thus each chamber, upon inflation, may exert an immediate opposing force upon the other chamber along the entire length of the respective chambers. The outside spatial configuration assumed by the third chamber which houses the two inflatable chambers is determined by the degree of inflation of each of the internal, inflatable chambers. Of course, more than two inflatable chambers may be employed within the exterior, encasing chamber.

In accordance with the second embodiment of the present invention, a single, inflatable chamber is employed, said chamber having a section of one wall which is less elastic than the remaining portion of the wall. Due to the differential in elasticity, upon inflation the chamber assumes a shape or configuration which is different from the chamber when noninflated. The chamber may be constructed and employed in the same fashion as the inflatable chambers used in accordance with the first aspect of the present invention, except that the chamber has one or more wall regions which are less elastic than the remaining wall area.

The wall regions of less elasticity may be achieved by any number of methodologies. In a preferred approach, a section of the wall of the chamber has a thickened region wherein the wall thickness is greater than that of the remaining wall. The amount of thickening is not critical and may vary over several orders of magnitude. Preferably, the thickening is from about 1 to about 10 orders of magnitude, in comparison to the thickness of the chamber's remaining wall regions. Alternatively, the particular wall section of lowered elasticity may be comprised of a material which is simply less elastic than that of the remaining wall regions. Modification of the surface properties of the wall may also be employed, as by application of inelastic coating compositions, or the like, in order to achieve the desired lowered elasticity of a portion of the wall. Other means of achieving the desired result will become apparent to those of skill in the art.

In accordance with the third embodiment of the present invention, two collapsible, fluid chambers, and associated means for controlling the fluid pressure in each of said chambers are provided. The chambers are each helically wound in opposite directions and placed substantially parallel to one another. At one spatial point one end of each chamber is rigidly mounted so that rotation of each respective chamber at that point is not possible. The other ends of each respective chamber are rigidly associated with each other so that rotation of one chamber causes rotation of the other in the same direction of rotation. Upon application of fluid pressure to either chamber, rotation of that chamber occurs, causing the helical windings of that chamber to unwind while commensurately causing the other chamber to be more tightly, helically wound. Upon release of the fluid pressure, the previously inflated chamber is again caused to be helically rewound to its initial state, due to the rotational force generated by the partial unwinding of the other chamber, until each chamber is wound back to its initial, helically wound state. The partial or complete inflation of either chamber causes all or a part of the figure to assume a different spatial position, dependent upon the level of inflation of each of said chambers.

The various aspects and embodiments of the present invention may be employed alone or in various combination to achieve the desired animation of any particular figure or figures.

The invention will be further illustrated by the Figures discussed below.

FIGS. 1A through 1E show an embodiment of the present invention in which two collapsible chambers 120 and 130 are contained within a flexible exterior sheath 110 which has been shaped to represent a human arm with an attached hand 112. Chamber 120 has an inflated or filled shape of a substantially straight cylinder, while chamber 130 has an inflated or filled shape of an "L". Chamber 120 is fluidly connected to conduit 122 which places chamber 120 in fluid communication with valve 124, which in turn is placed in fluid communication with fluid supply 140 by means of conduit 126. Similarly, chamber 130 is connected to conduit 132 which places chamber 130 in fluid communication with valve 134, which in turn is placed in fluid communication with fluid supply 140 by means of conduit 136.

Chamber 120 is also fluidly connected to conduit 123 which places chamber 120 in fluid communication with valve 125, which in turn is placed in fluid communication with fluid evacuation chamber 150 by means of conduit 127. Similarly, chamber 130 is connected to conduit 133 which places chamber 130 in fluid communication with valve 135, which in turn is placed in fluid communication with fluid evacuation chamber 150 by means of conduit 137. Pump 160 is placed in fluid communication with both fluid supply 140 and fluid evacuation chamber 150 by means of conduits 162 and 164, respectively.

Valves 124, 125, 134 and 135 are connected to actuator means 128, 129, 138 and 139, respectively (not shown). The valves may be electro-mechanical valves which are actuated by electric current, as is well known in the art. Any type of valve may be employed, as well as any actuator means, including electrical, mechanical, pneumatic, or the like.

Figures 1, 1A, 2:
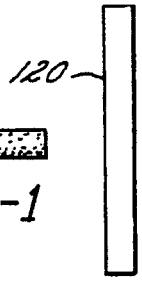
Figure 1A:
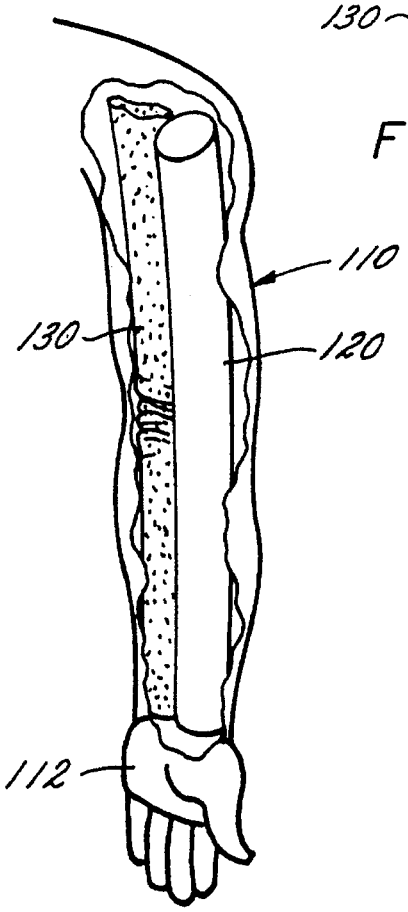
Figure 1C:
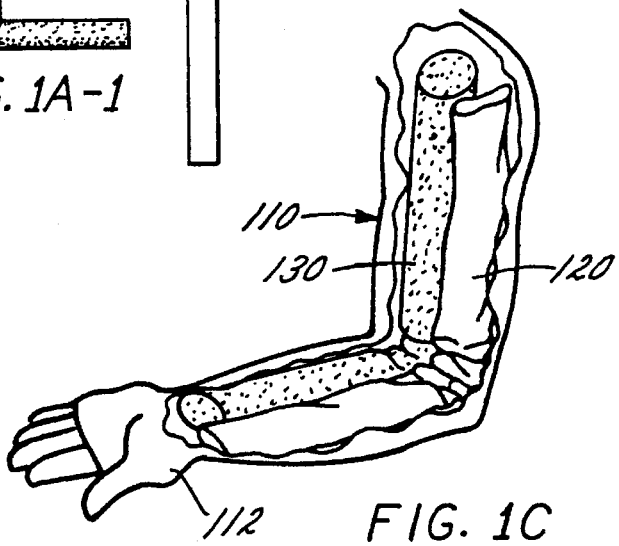
Figure 1B:
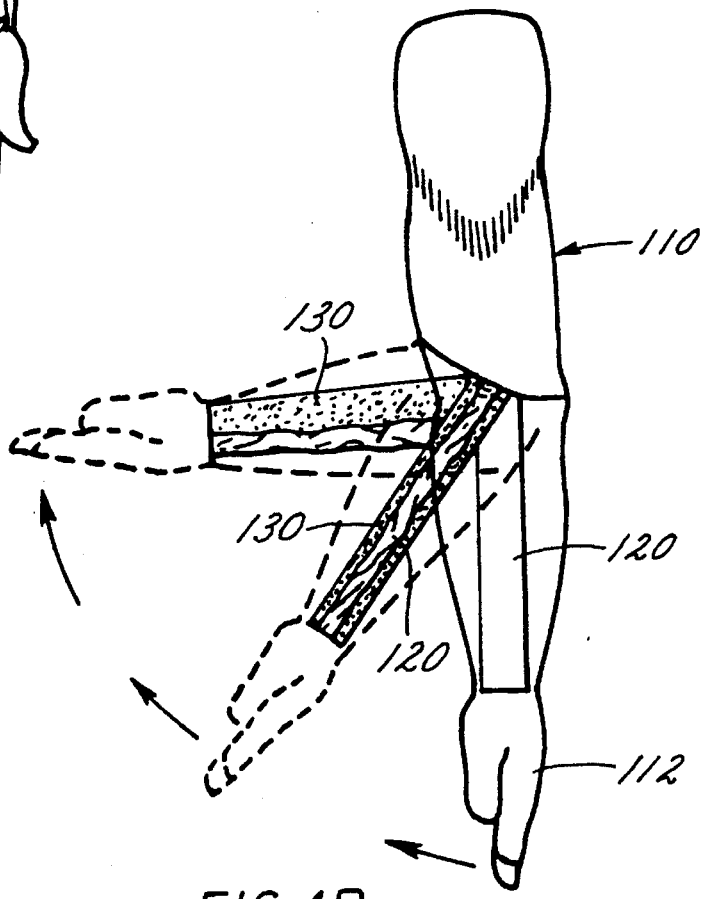
Figure 1D:
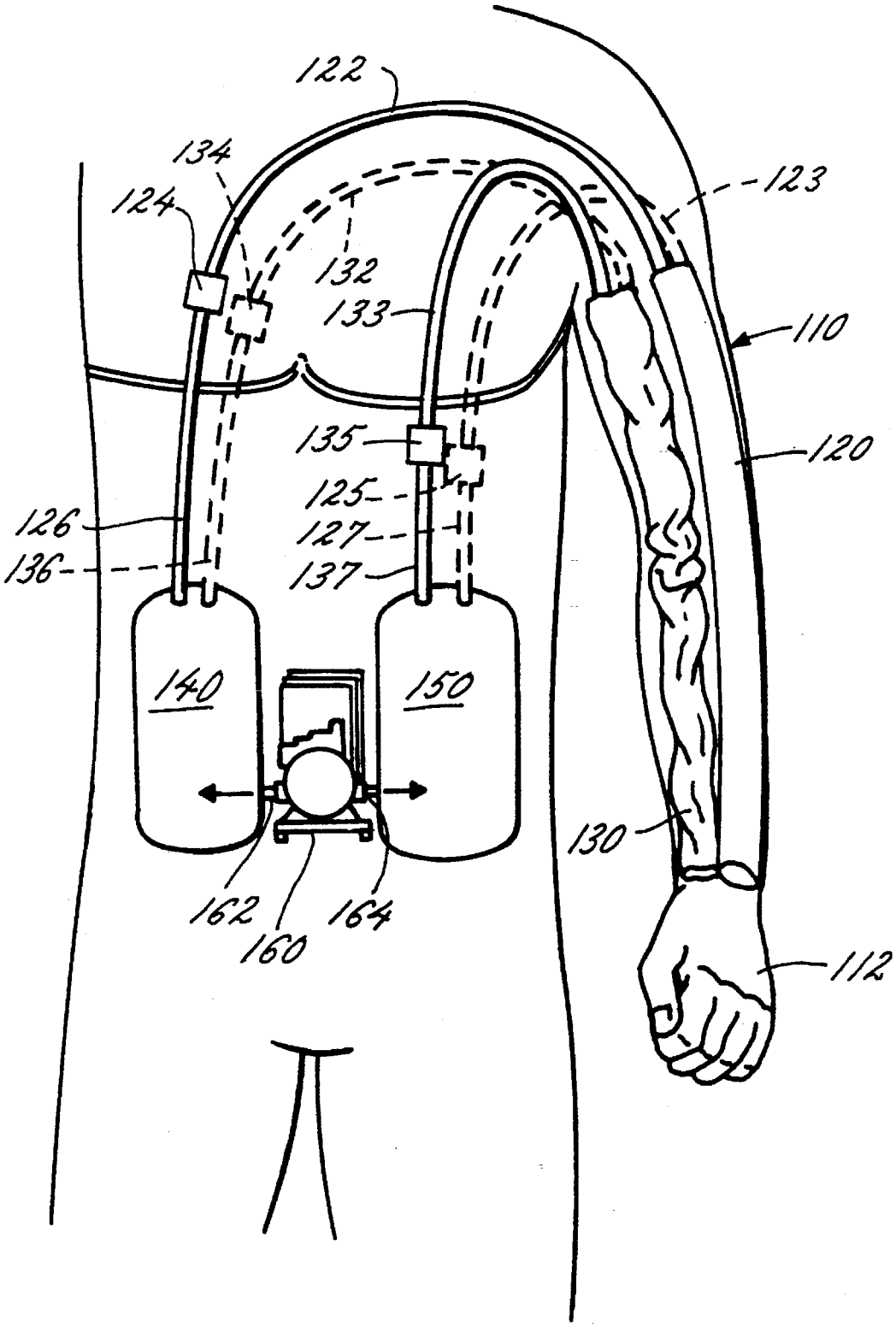

In operation, extension of the arm is achieved by inflating chamber 120 by opening valves 124 and 135 and closing valves 125 and 134, as shown in FIGS. 1A and 1D. In this manner, fluid flows from fluid supply 140 to fully inflate chamber 120, while fluid is drawn from chamber 130 into fluid reservoir 150. Pump 160 is demand activated and supplies pressure, if necessary, to evacuate reservoir 150 and to pressurize fluid supply 140. The speed with which the arm moves from one position to another is directly dependent upon the pressure differential maintained between the fluid supply 140 and the fluid reservoir 150.

Figure 1E:
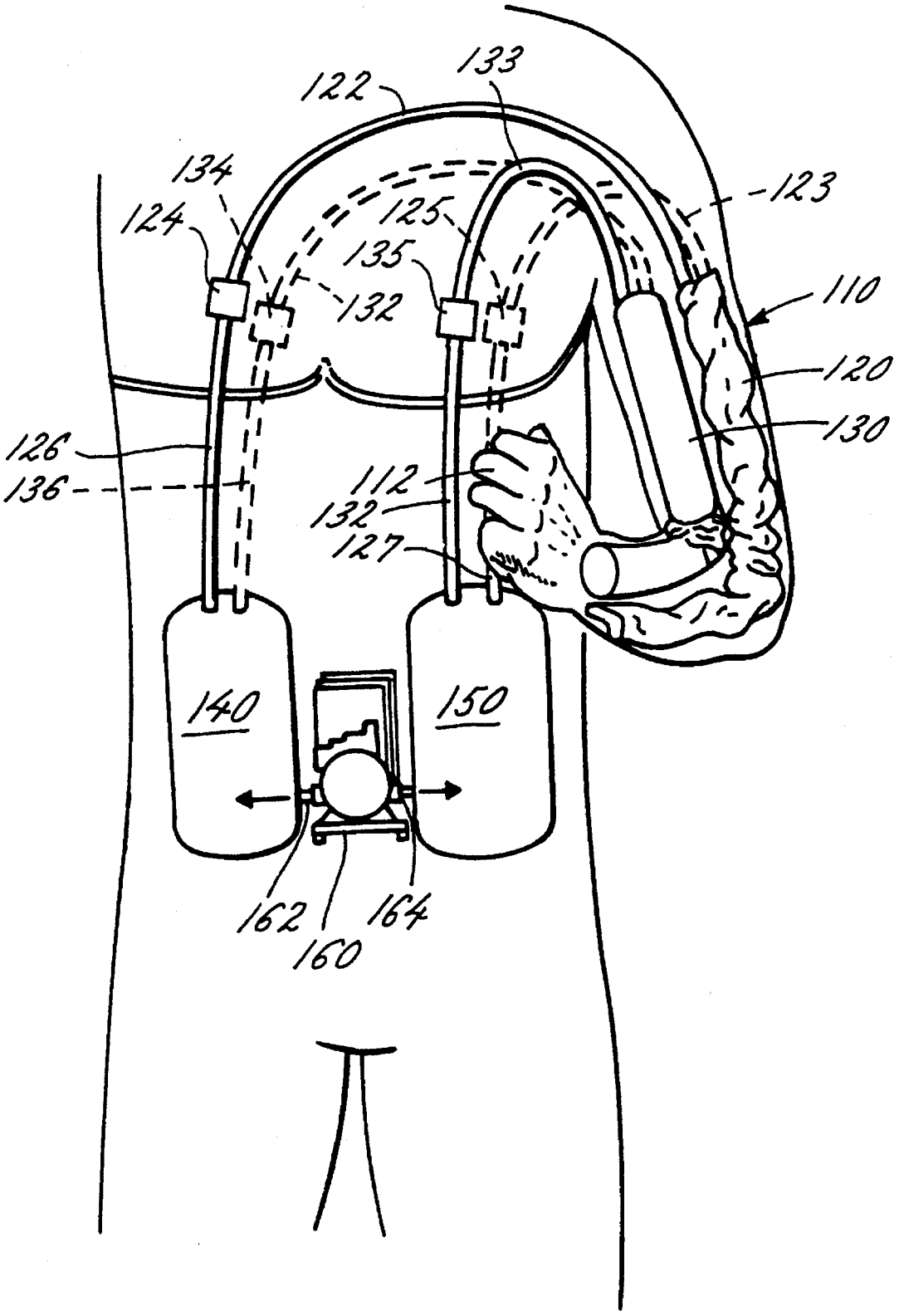

To achieve motion of the arm and movement of the arm to a "bent" configuration, valves 124 and 135 are closed and valves 125 and 134 are opened, causing chamber 120 to be evacuated and chamber 130 to be inflated, as shown in FIGS. 1B and 1E. By controlling the valves to allow both chambers 120 and 130 to become partially filled and partially evacuated, incremental positions between fully extended and fully bent can be achieved, as shown in FIG. 1C.

As can be readily ascertained from FIG. 1, inflation of either chamber 120 or chamber 130 causes the inflated chamber to exert a force on the other chamber, tending to cause collapse of that other chamber. Although FIG. 1 represents a preferred embodiment, other simplified embodiments are also possible, although less desired. Because inflation of either chamber 120 or chamber 130 causes a collapsing force to be exerted, it is not necessary in all instances that the evacuation chamber and associated conduit be employed. Thus, for example, conduits 126 and 136 can be eliminated, which would then allow the fluid, such as air, to escape to the environment, upon the opening of valves 124 or 134, once collapsing pressure is applied by virtue of the inflation of the other chamber.

Figure 1F:
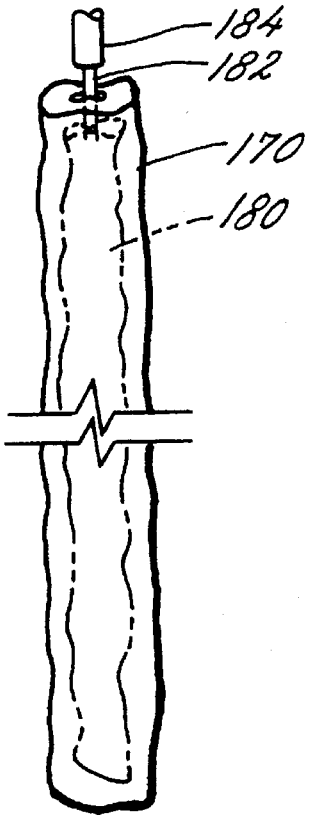
FIGS. 1F, 1G and 1H illustrate one aspect of the first embodiment of the present invention in which a straight, exterior, noninflatable chamber surrounds an internal, inflatable chamber which has a curved configuration when inflated.
Figure 1G:
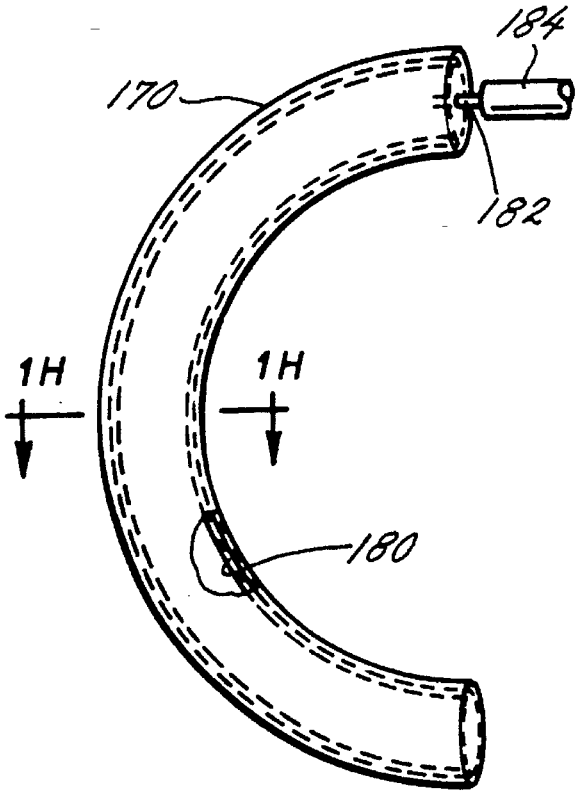
Figure 1H:
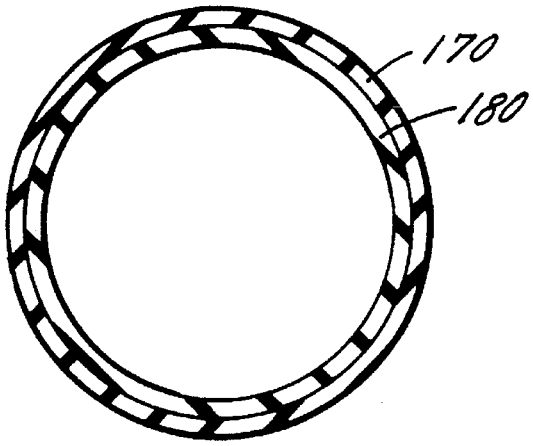

FIGS. 1F through 1H illustrate an embodiment of the present invention in which two chambers are employed wherein one chamber 180 is located within the other chamber 170 and only chamber 180 is inflatable. The noninflatable chamber 170 has a spatial orientation which is different from the spatial orientation of the inflatable chamber 180 when inflated. When the inflatable chamber 180 is not inflated, the figure assumes the shape of the noninflatable chamber as illustrated in FIG. 1F. When the inflatable chamber 180 is inflated, however, the inflation of the chamber causes all or a part of the figure to assume a different position, dependent upon the level of inflation of that chamber. Typically, the exterior chamber will be the noninflatable chamber and the interior chamber will be the inflatable chamber, although the reverse configuration could be employed, although with more difficulty. In FIGS. 1F through 1H, a conduit 184 is connected to the interior of inflatable chamber 180 through aperture 182. Conduit 184 is connected to a source of pressurized fluid, not shown.

In FIG. 1F, the spatial configuration of the combination of chambers is that of the exterior chamber 170 which is a straight tube. As illustrated in FIG. 1G, upon inflation of chamber 180 it assumes its inflated shape of a curve, forcing the exterior chamber 170 to also assume the shape of a curse. FIG. 1H shows the cross-sectional view of chambers 170 and 180 when chamber 180 is inflated, illustrating the fact that the exterior of the wall of chamber 180 impinges upon the interior of the wall of chamber 170, forcing chamber 170 to assume the configuration of a curve.

Figure 2A:
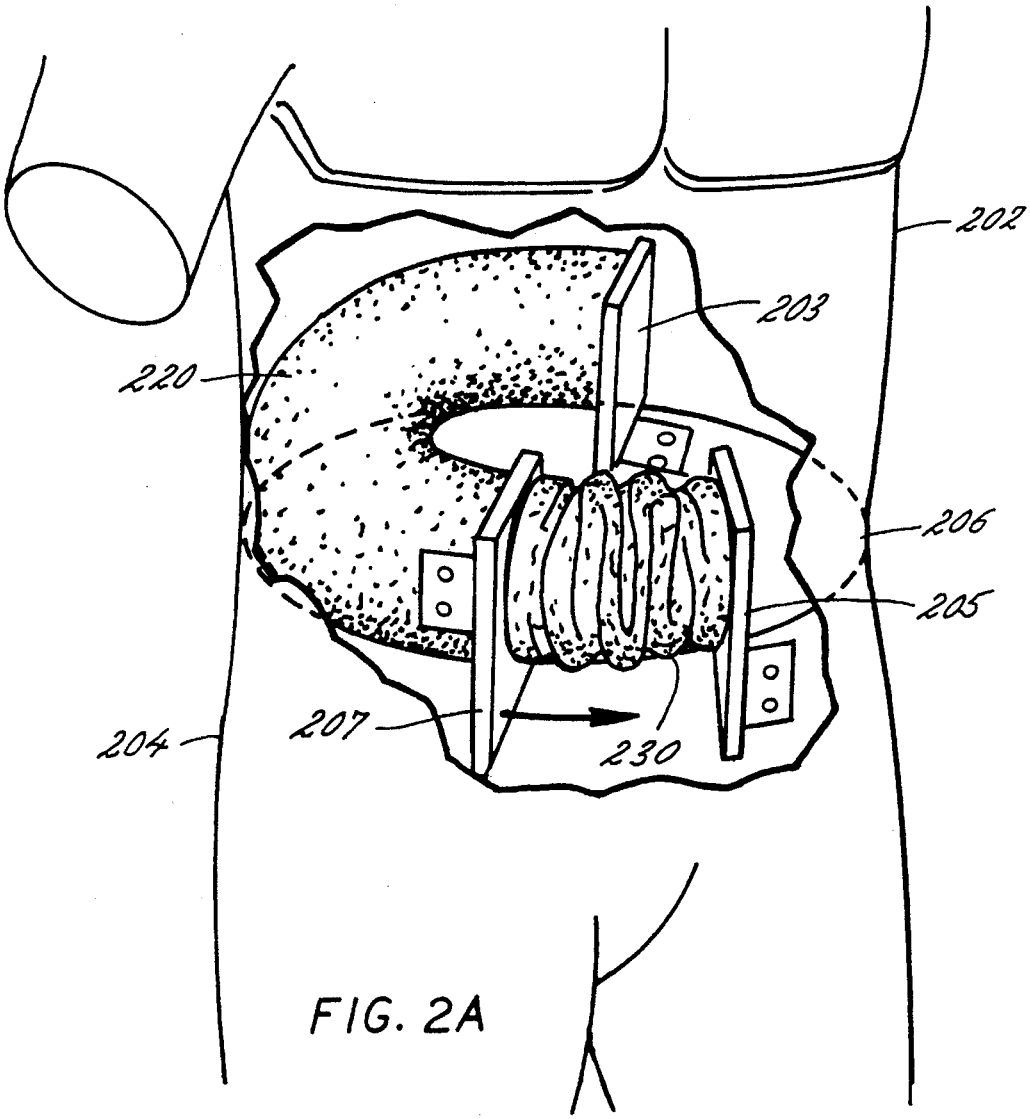
FIGS. 2A, 2B, 2C, 2D, 2E and 2F show another aspect of the first embodiment of the present invention in which rotational animation is achieved for a torso of a human figure.
Figure 2D:
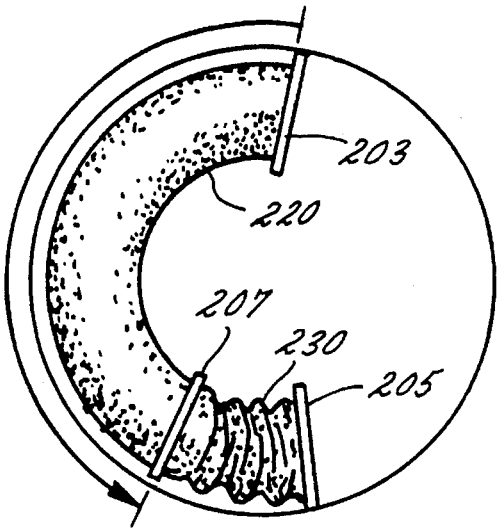
Figure 2B:
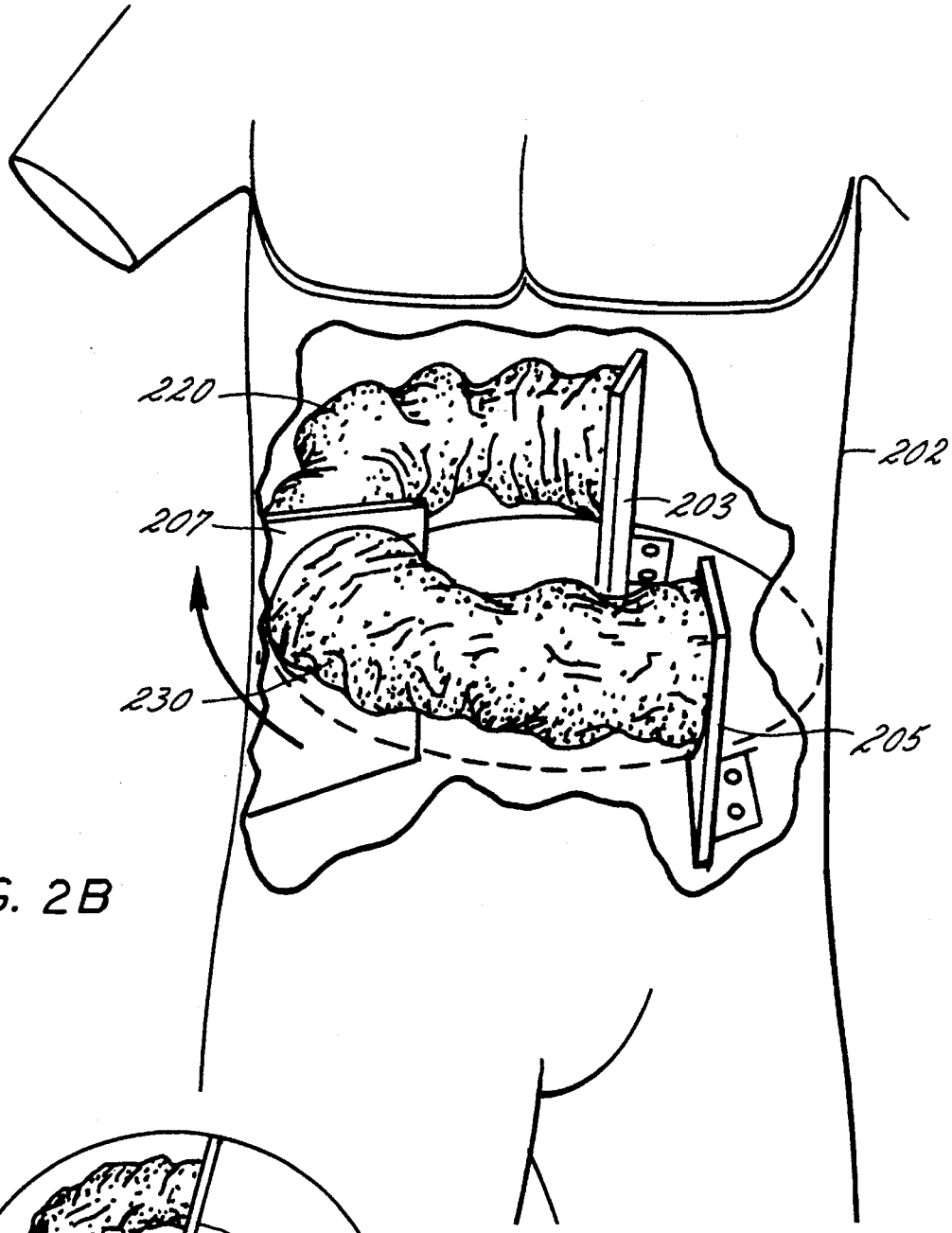
Figure 2E:
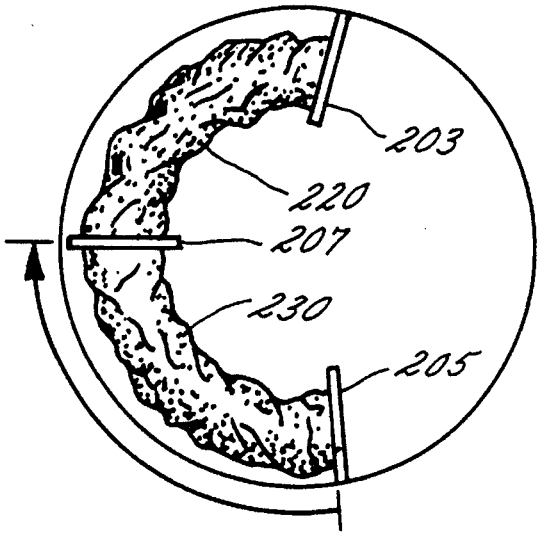
Figure 2C:
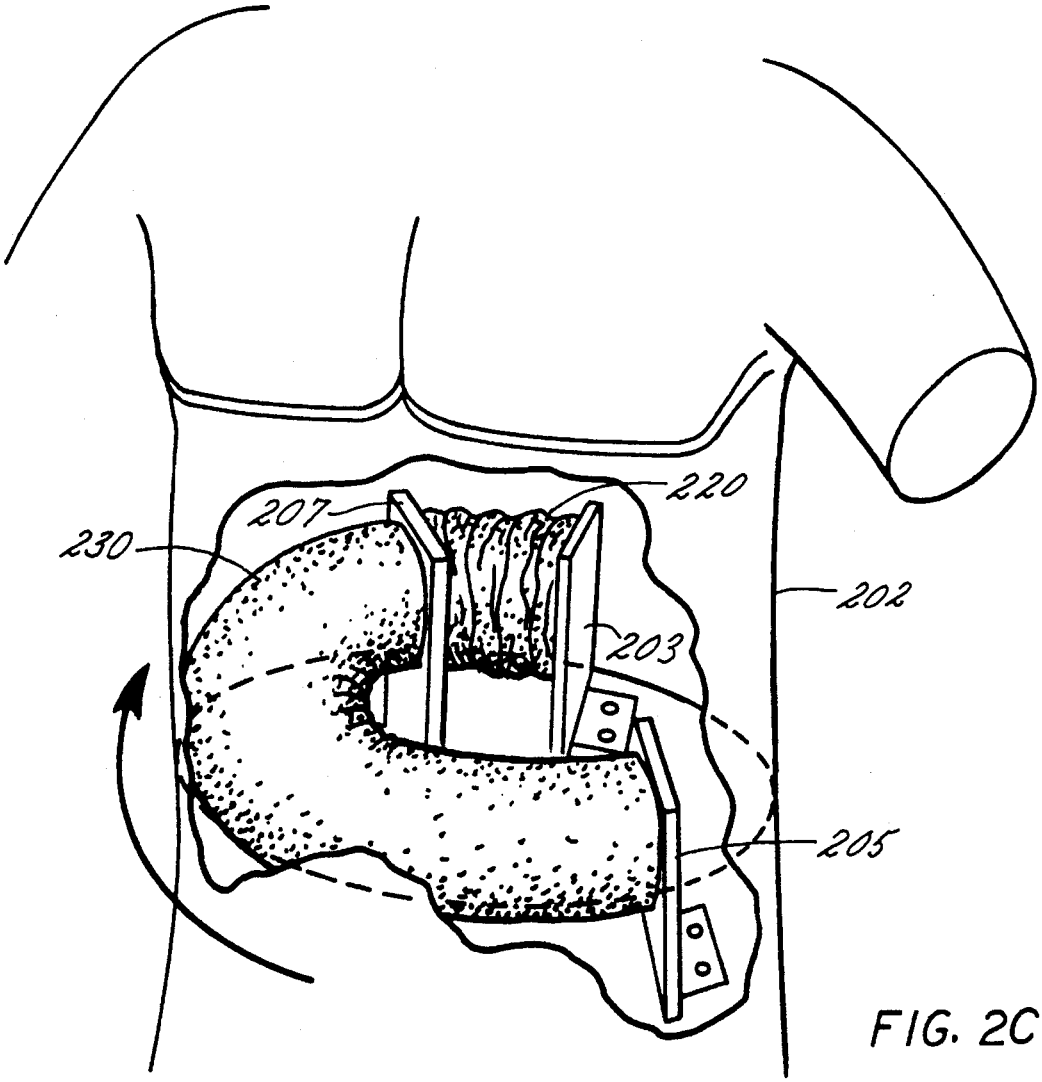
Figure 2F:
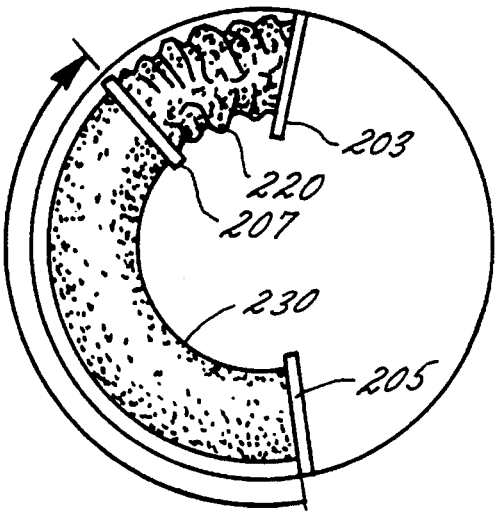

FIGS. 2A through 2F are illustrations of another embodiment of the present invention in which 200 represents, generally, a replication of a human torso having an upper half 202 and a lower half 204. The upper half is rotationally mounted to the lower half at junction 206. Collapsible chambers 220 and 230, when inflated, have the configuration of a segment of a circle and are rigidly mounted at opposite end to the lower half of the torso 204 by means of attaching plates 203 and 205, respectively. The collapsible chambers 220 and 230 are mounted to a common attaching plate 207 which is also rigidly mounted to the upper half of the torso 202. Inflation of chamber 220 causes rotation of the upper half of the torso 202 in a counter-clockwise direction, as shown in FIG. 2A and 2D, while inflation of chamber 230 causes rotation of the upper half of the torso 202 in a clockwise direction, as shown in FIGS. 2C and 2F. The collapsible chambers may be easily placed in fluid communication with a fluid supply source and an evacuation chamber in a manner similar to that shown in FIG. 1. From FIG. 2 it is readily apparent that inflation of either chamber 220 or chamber 230 causes a directly opposing collapsing force to be applied to the other chamber. The pressure differential maintained between the fluid supply and the fluid reservoir sides of the system again controls the speed at which the torso will rotate.

Partial evacuation and partial pressurization of both chambers 220 and 230 causes the upper torso 202 to be rotated to intermediate positions between full clockwise rotation and full counter-clockwise rotation, as shown in FIGS. 2B and 2E.

Figure 3A:
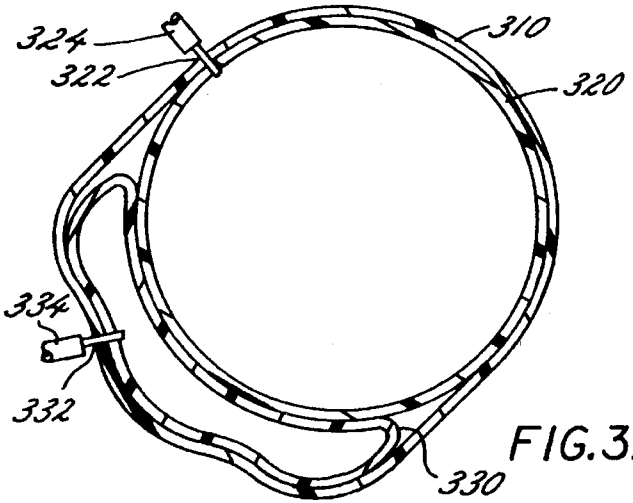
FIGS. 3A and 3B show an aspect of the first embodiment of the present invention in which two inflatable chambers are both located within a third chamber which is not directly inflated, but responds in configuration to the inflation, in whole or in part, of the two interior chambers.
Figure 3B:
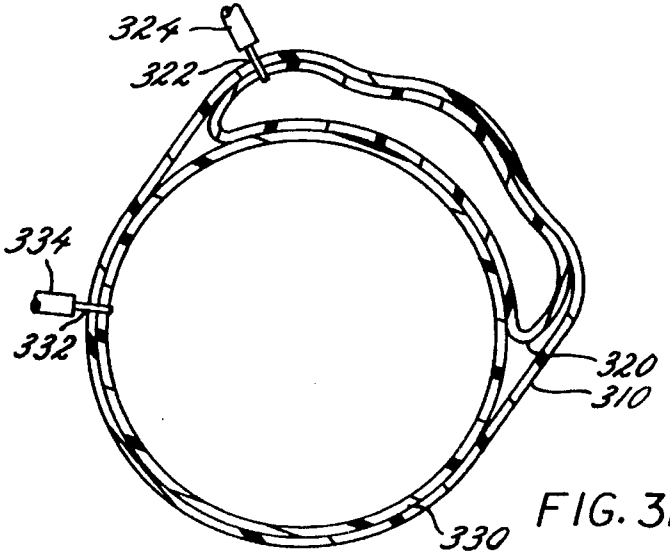

In FIGS. 3A and 3B, cross-sections of two inflatable chambers are illustrated, surrounded by a third chamber which encases the inflatable chambers. In said figures, inflatable chambers 320 and 330 are located within chamber 310 which encases both chambers 320 and 330. Orifice 322 passes through both chambers 310 and 320 while orifice 332 passes through chambers 310 and 330. Conduits 324 and 334, respectively, pass through orifices 322 and 332 and independently are in fluid communication with a source of pressurized fluid. As illustrated in FIG. 3A, chamber 320 is inflated completely, while chamber 330 is essentially evacuated. In FIG. 3B, chamber 330 is inflated completely, while chamber 320 is essentially deflated. Chamber 310 conforms to the spatial configuration of the inflated chamber in each of the two positions illustrated in FIGS. 3A and 3B. Such chambers may be, for example, normally straight and normally bent tubing, respectively, as shown in FIGS. 1A, 1B, and 1C.

Figure 4C:
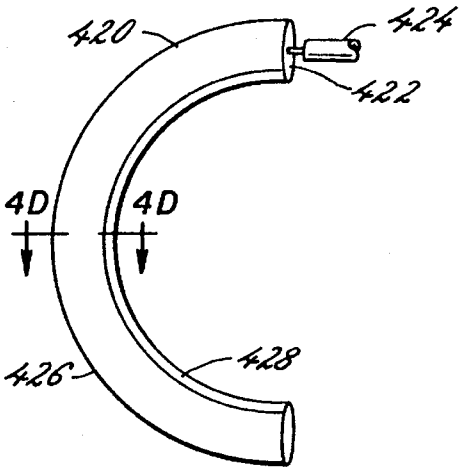
FIGS. 4A, 4B, 4C and 4D illustrate an aspect of the second embodiment of the present invention in which a single, inflatable chamber is employed, said chamber having a section of one wall which is thickened so that it is less elastic than the remaining portion of the wall.
Figure 4D:
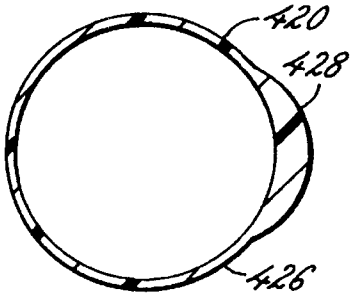
Figure 4A:
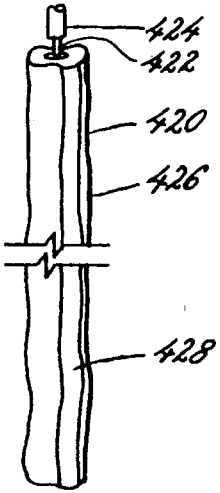
Figure 4B:
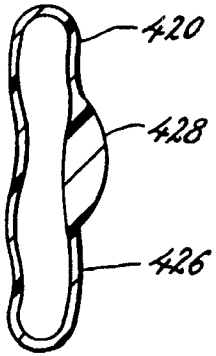

FIGS. 4A, 4B, 4C and 4D illustrate an aspect of the second embodiment of the present invention in which a single, inflatable chamber is employed, said chamber having a section of one wall which is thickened so that it is less elastic than the remaining portion of the wall. Chamber 420 has an orifice 422 located at one end thereof, into which conduit 424 has been inserted to fluidly communicate with the interior of chamber 420. The wall of chamber 420 is comprised of a relatively thin wall segment 426 and a thickened wall segment 428 which is substantially less elastic than the wall segment 426. When in a deflated state, as illustrated in FIG. 4A, the chamber is essentially a straight cylinder, which may be flattened, as illustrated in FIG. 4B. When fluid pressure is applied, as illustrated in FIG. 4C, the chamber 420 assumes the form of an arc, due to the fact that the thickened region 428 does not stretch as much as the remaining wall segment 426, causing the deformation of the chamber when subjected to fluid pressure, such as air pressure. FIG. 4D is a cross-section of the inflated chamber 420 of FIG. 4C, taken along line 4D—4D, showing that the chamber still has a substantially circular cross-section, when subjected to fluid inflation pressure.

Figure 5A:
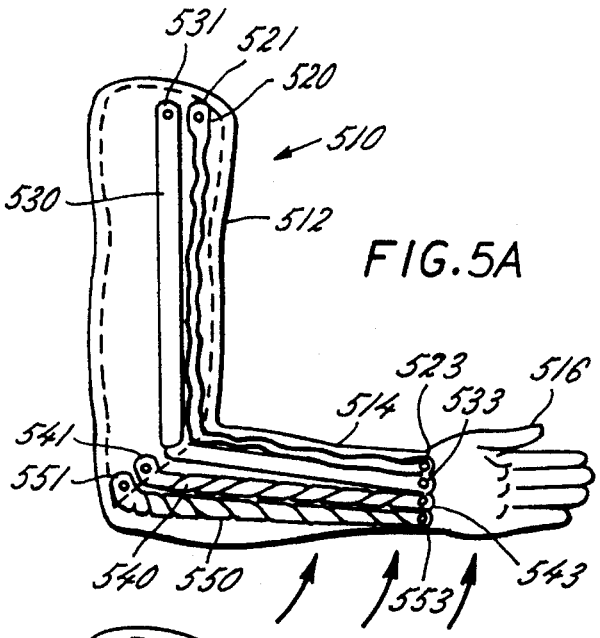
FIGS. 5A, 5B and 5C illustrate an aspect of the third embodiment of the present invention in which two collapsible, fluid chambers are provided, wherein the chambers are each helically wound in opposite directions and placed substantially parallel to one another.
Figure 5B:
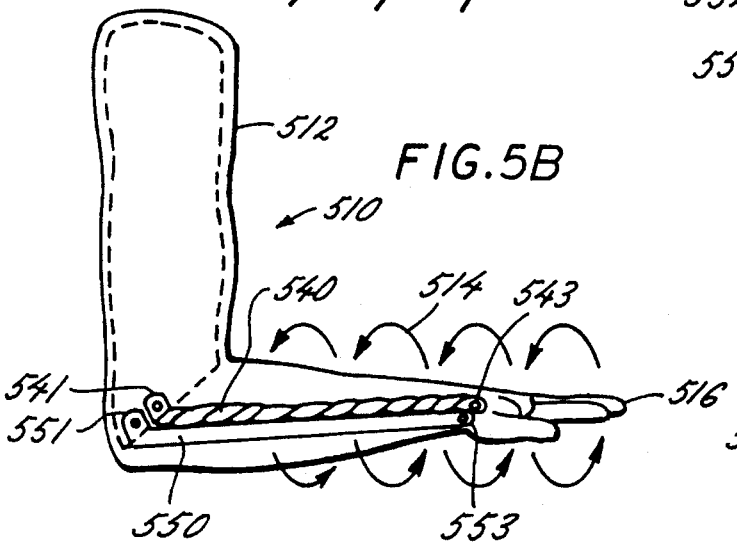
Figure 5C:
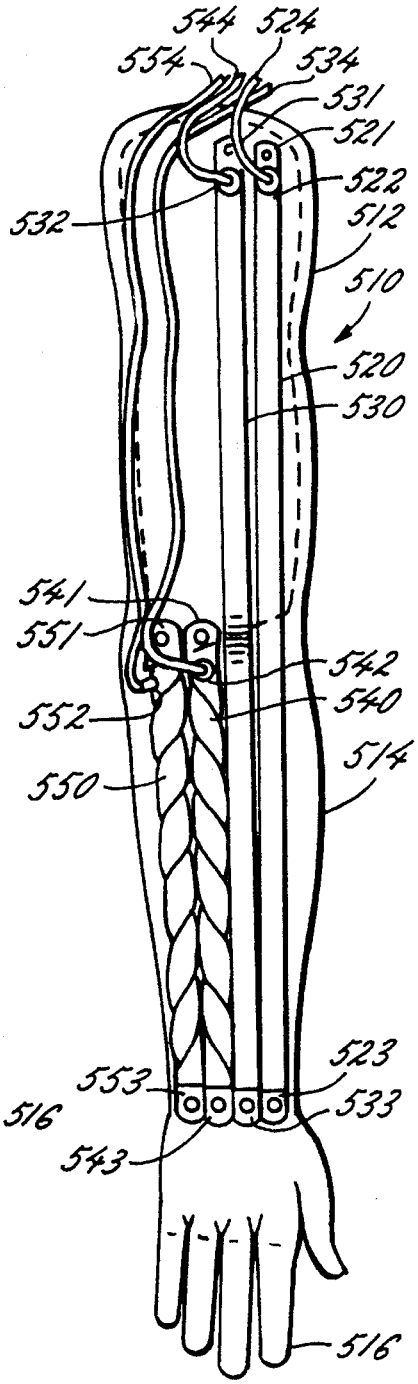

FIGS. 5A, 5B and 5C illustrate an aspect of the third embodiment of the present invention in which two collapsible, fluid chambers are provided, wherein the chambers are each helically wound in opposite directions and placed substantially parallel to one another. As illustrated in each of the three figures, a replication of a human arm and hand combination 510 is provided, having an upper arm portion 512, a lower arm portion 514, and a hand assembly 516. Located within the upper and lower arm assemblies 512 and 514, are chambers 540 and 550 which are rigidly and immovably fixed at one end thereof to the upper arm portion 512 by connections 541 and 551. Chambers 540 and 550 are also attached to the hand assembly 516 through connection 543 and 553. The lower arm and hand assembly are both free to rotate, while the upper arm 512 is fixed so that rotational motion is not possible. Chambers 540 and 550 each have orifices 542 and 552, as illustrated in FIG. 5C into which are inserted conduits 544 and 554, respectively, which communicate with a source of compressed air, not shown.

When initially present in their deflated state, both chambers 540 and 550 are helically wound around their longitudinal axis, in opposite directions. Each chamber in its helically wound state exerts equal and opposing force on the other so that an equilibrium position is established as shown in FIG. 5A, wherein the hand assembly 516 has assumed a substantially vertical position.

Upon application of fluid pressure to either chamber 540 or 550, the chamber is caused to unwind. In FIG. 5A, fluid pressure has been applied to chamber 550, causing it to fully unwind, while causing chamber 540 to becomes even more tightly, helically wound about its longitudinal axis. This unwinding of chamber 550 and further winding of chamber 540, causes hand assembly 516 to rotate to a "palm-up" position as shown in FIG. 5B. When pressure is released from conduit 550, the increased force present in chamber 540, caused by the additional winding of that chamber beyond its equilibrium point with chamber 550, causes chamber 540 to unwind and chamber 550 to wind, helically about their longitudinal axes, until the equilibrium point illustrated in FIG. 5A is again reached. Of course, intermediate levels of inflation of chamber 550 may be maintained, causing the hand assembly 516 to assume any desired position. Similarly, chamber 540 may be inflated and caused to unwind, with commensurate winding of chamber 550, until a "palm-down" position is achieved.

In FIG. 5C, there is illustrated a composite structure which utilizes aspects of both the second and third embodiments of the present invention, in combination. Thus, as illustrated in FIG. 5C, in addition to the two helically wound chambers 540 and 550 and their associated components, as discussed previously, there are also present chambers 520 and 530, which have orifices 522 and 532, respectively. Inserted in the orifices are conduits 524 and 534, respectively, which communicate with a source of fluid pressure, not shown. Chamber 520 is rigidly fixed to upper arm 512 through connection 521, while chamber 530 is so fixed through connection 531. The lower portion of chamber 520 is fixed to hand assembly 516 through connection 523 and the lower portion of chamber 530 is so fixed through connection 533.

As previously illustrated in FIGS. 1A, 1B and 1C, chambers such as 520 having a normally straight cylindrical configuration and chamber 530 having a normally bent configuration, when inflated, can cause animation motion of a portion of a figure to occur by controlling the amount of inflation or deflation of each such chamber. In the particularly illustrated embodiment, relative motion of the lower arm portion 514 with respect to the upper arm portion 512 can be achieved through control of the inflation pressure in chambers 520 and 530. Simultaneously, and independently, rotational movement of the hand assembly 516 may be achieved through selective control of the inflation pressure within chambers 540 and 550. In such a manner, it is possible to closely simulate the movements of a human arm and hand. Other figures and appendages thereof may, of course, be achieved in similar manners through routine modification of the foregoing specific embodiments.

Although the invention has in various instances been specifically described in terms of pairs of two collapsible chambers, it is clear that more than two interacting chambers may be employed within the spirit and scope of the present invention, especially if more complicated motion or movement is desired. The present invention should be especially well suited for use in duplicating the complex movements, such as that exhibited by a human hand. Also, because there is no significant limitation upon the pressure which may be employed in the system, high levels of strength may be exhibited by the figures which are animated through use of the present invention.

I claim:

1. An apparatus for rotating a rotatable member about its longitudinal axis in an animated figure, the apparatus comprising: (1) a first collapsible, fluid chamber having a first end fixedly attached to a secured portion of the animated figure and a second end fixedly attached to said rotatable member; (2) a second collapsible, fluid chamber disposed substantially parallel to said first collapsible, fluid chamber, said second chamber having a first end fixedly attached to said secured portion of said animated figure and a second end fixedly attached to said rotatable member, said first and second chambers both being capable of being repetitively inflated to a predetermined, desired shape and subsequently deflated, said first and second chambers being each helically wound in opposite directions and; (3) means for controlling the fluid pressure in each of said first and second chambers so that the inflation of said first chamber and deflation of said second chamber causes the first chamber to unwind and the second chamber to become more tightly helically wound to thereby rotate said rotatable member about its longitudinal axis.

2. The apparatus of claim 1, wherein said first and second chambers are disposed substantially parallel to said longitudinal axis of rotation of said rotatable member and said first and second chambers rotate about said longitudinal axis in a direction and amount dependent upon their respective fluid pressures.

3. A method for attaining animated movement in a figure by rotating a rotatable member about its longitudinal axis comprising the steps of: providing the interior of said figure with first and second collapsible, fluid chambers positioned substantially parallel to said longitudinal axis of the rotatable member, said first and second chambers being capable of repetitive inflation to a desired shape and subsequently deflated, each of said first and second chambers being helically wound in opposite directions and each having a first end fixedly attached to a secured portion of said figure and a second end opposite said first end fixedly attached to said rotatable member; inflating said first chamber to a predetermined inflation level and deflating said second chamber to a predetermined inflation level to thereby unwind said first chamber and more tightly wind said second chamber to rotate said rotatable member about its longitudinal axis.

4. The method of claim 3 further comprising the step of selectively controlling the inflation levels of the first and second chambers to controllably adjust the rotational position of the rotatable member relative to said longitudinal axis.

* * * * *